US006589302B1

(12) United States Patent
DeRosa et al.

(10) Patent No.: US 6,589,302 B1
(45) Date of Patent: Jul. 8, 2003

(54) FRICTION MODIFIER FOR POOR LUBRICITY FUELS

(75) Inventors: Thomas F. DeRosa, Southbury, CT (US); Thomas Cangelosi, Newburgh, NY (US); Serge A. Cryvoff, Pleasant Valley, NY (US); Frank J. DeBlase, Hopewell Junction, NY (US); Thomas E. Hayden, Wappingers, NY (US); Benjamin J. Kaufman, Hopewell Junction, NY (US); James R. Ketcham, Salt Point, NY (US); Michael Rawdon, Poughkeepsie, NY (US); Yvonne Thiel, Carmel, NY (US)

(73) Assignee: Texaco Inc., San Ramon, CA (US)

( * ) Notice: Subject to any disclaimer, the term of this patent is extended or adjusted under 35 U.S.C. 154(b) by 0 days.

(21) Appl. No.: 09/598,726

(22) Filed: Jun. 21, 2000

Related U.S. Application Data

(60) Provisional application No. 60/202,609, filed on May 9, 2000.

(51) Int. Cl.[7] ..... C10L 1/14

(52) U.S. Cl. ..... 44/418; 44/385; 44/391; 44/400

(58) Field of Search ..... 44/385, 391, 308, 44/418

(56) References Cited

U.S. PATENT DOCUMENTS

| | | | | | |
|---|---|---|---|---|---|
| 4,204,481 | A | | 5/1980 | Malec | |
| 4,208,293 | A | | 6/1980 | Zaweksi | |
| 4,236,898 | A | | 12/1980 | Davis et al. | |
| 4,439,336 | A | | 3/1984 | Zaweski | |
| 4,491,455 | A | | 1/1985 | Ishizaki et al. | |
| 4,509,954 | A | | 4/1985 | Ishizaki et al. | |
| 4,729,769 | A | | 3/1988 | Schlicht et al. | |
| 5,229,036 | A | * | 7/1993 | Sienkowski et al. | 564/135 |
| 5,512,190 | A | * | 4/1996 | Anderson et al. | |
| 5,855,628 | A | | 1/1999 | Hashimoto et al. | 44/308 |
| 5,855,630 | A | | 1/1999 | Lin et al. | 44/419 |
| 5,882,364 | A | | 3/1999 | Dilworth | 44/400 |
| 5,891,203 | A | | 4/1999 | Ball et al. | 44/488 |
| 5,928,393 | A | | 7/1999 | Ishida et al. | 44/387 |
| 5,964,907 | A | * | 10/1999 | Farmer et al. | 44/391 |
| 6,001,141 | A | | 12/1999 | Quigley | 44/386 |
| 6,013,114 | A | | 1/2000 | Hille et al. | 44/308 |
| 6,013,115 | A | | 1/2000 | Kanakia et al. | 44/391 |
| 6,017,370 | A | | 1/2000 | Manka et al. | 44/397 |

FOREIGN PATENT DOCUMENTS

| | | |
|---|---|---|
| EP | 0085803 B1 | 8/1983 |
| EP | 0553100 B1 | 8/1993 |
| EP | 0739970 A1 | 10/1996 |
| EP | 0755996 A1 | 1/1997 |
| EP | 0773278 A1 | 5/1997 |
| EP | 0773279 A1 | 5/1997 |
| EP | 0798364 A1 | 10/1997 |
| GB | 2307246 A | 5/1997 |
| GB | 2307247 A | 5/1997 |
| GB | 2336119 A | 10/1999 |
| GB | 2336120 A | 10/1999 |
| WO | WO 9900467 | 1/1999 |

OTHER PUBLICATIONS

Schey, *Tribology in Metalworking*, Friction, Lubrication and Wear, Canes Publication Services, Inc., pp. 136–137, 1983.*

* cited by examiner

*Primary Examiner*—Margaret Medley
(74) *Attorney, Agent, or Firm*—Dilworth & Barrese, LLP

(57) ABSTRACT

An additive concentrate for improving the lubricity of low sulfur fuels comprises an additive composition diluted in an aromatic solvent, said composition comprising the reaction product of a first glyceride possessing an unsaturated fatty acid content of at least about 40 mole %, based on the total weight of fatty acid present in the first glyceride, and an iodine number of greater than 35, a second glyceride possessing an unsaturated fatty acid content of less than about 20 mole %, based on the total weight of the fatty acids present in the second glyceride, and an iodine number of less than 35, and, at least one alkanolamine. The concentrate remains fluid and stable at low temperatures and, when added to low sulfur fuels, improves lubricity, enhances fuel economy and minimizes engine deposits.

20 Claims, No Drawings

FRICTION MODIFIER FOR POOR LUBRICITY FUELS

CROSS REFERENCE TO RELATED APPLICATIONS

This application claims priority to U.S. Provisional Application Ser. No. 60/202,609, filed May 9, 2000.

BACKGROUND OF THE INVENTION

1. Field of the Invention

This invention relates to a fuel additive concentrate comprising a fuel additive for improving the lubricity of fuels such as diesel and gasoline, to the fuel additized with the fuel additive concentrate and to a method of operating an internal combustion engine with said fuel. The fuel additive concentrate remains fluid and stable at low temperatures and is therefore suitable for addition to fuels at low temperatures. Fuels containing the fuel additive exhibit improved lubricity and reduced friction which is reflected in enhanced vehicle fuel economy and reduced engine deposits.

2. Background of the Invention

Sulfur compounds are oxidized and discharged into the air as fuels are burned, leading to environmental problems such as "acid rain". Since untreated diesel fuels contain 1% by weight or more of sulfur, the need to improve air quality has led to the development of fuels with minimized sulfur content. The sulfur content of fuels such as diesel fuel can be reduced by additional refining, e.g., by severely hydrotreating diesel fuel to produce a low sulfur content fuel. It is now considered desirable to reduce the level of sulfur in such fuels to less than 0.2% by weight and, preferably, to less than 0.05% by weight, more preferably less than 0.01% by weight. However, it is generally recognized that these additional refining operations dramatically diminish fuel lubricity. The term "lubricity," as utilized herein, refers to the ability of the fuel to reduce the friction on and subsequent wear of these moving parts. Fuels act as a primary source of lubrication for moving parts located inside engine systems, e.g., rotary/distributor fuel pumps, fuel ignition systems, and the like. Therefore, a fuel having diminished lubricity will result in increased friction and wear on those moving parts that are primarily lubricated by the fuel alone.

Another attempt at improving the quality of the air is through the implementation of government legislated fuel economy standards. This legislation has led automotive and fuel additive suppliers to undertake efforts to enhance the fuel economy of motor vehicles. It is especially desirable to enhance the fuel economy of vehicles operated on poor lubricity fuels.

One approach to achieving enhanced fuel economy is by improving the efficiency of the engine in which the fuel is used. Improvement in engine efficiency can be achieved through a number of methods, e.g., improved control over fuel/air ratio, decreased crankcase oil viscosity, reduced internal friction at specific, strategic areas of an engine, etc. For example, inside an engine, about 18% of the fuel's heat value, i.e., the amount of heat released in the combustion of the fuel and therefore able to perform work, is dissipated due to internal friction at engine components, e.g., bearings, valve train, pistons, rings, water and oil pumps, etc. Only about 25% of the fuel's heat value is converted to useful work at the crankshaft. Friction occurring at the piston rings and part of the valve train account for over 50% of the heat value loss. A lubricity improving fuel additive capable of reducing friction at these engine components by a third will cause approximately 3% of the fuel's heat value to be transmitted as useful work at the crankshaft, thus improving vehicle fuel economy.

Most fuels are additized by injecting a homogeneous, low viscosity and liquid additive concentrate into the fuels while they are loaded into trucks at terminal racks. Commonly such additives are diluted in an aromatic solvent (e.g., xylene, aromatic 100, heavy aromatic naphtha) to produce a homogeneous, low viscosity fluid concentrate which is suitable for rack injection. Obviously, the additive concentrate must be fluid, homogeneous and low in viscosity under all atmospheric conditions encountered at such outdoor truck loading facilities. Unfortunately, many fuel additive concentrates are unsuitable for additization at low temperature. For example, Tolad 9103 (Baker Hughes, Inc., Pasadena, Tex.), a mixture of polymerized fatty acids and non-polymerized fatty acids dissolved in heavy aromatic naphtha, turns solid at 0° F. within one day.

Therefore, there has been a continual search for fuel additives which improve the lubricity of low sulfur fuels and which remain stable at low temperatures when diluted in aromatic solvents.

SUMMARY OF THE INVENTION

In accordance with the present invention, a fuel additive concentrate for improving the lubricity of fuels containing less than about 0.2 weight percent sulfur is provided, the concentrate comprising a fuel additive composition diluted in an aromatic solvent, said fuel additive composition representing from about 0.5 to about 90 weight percent of the total weight of the concentrate, said fuel additive composition comprising the reaction product of:

(1) a first glyceride possessing an unsaturated fatty acid content of at least about 40 mole %, based on the total weight of fatty acid present in the first glyceride, and an iodine number of greater than 35;

(2) a second glyceride possessing an unsaturated fatty acid content of less than about 20 mole %, based on the total weight of the fatty acids present in the second glyceride, and an iodine number of less than 35; and, (3) at least one alkanolamine.

Also provided is a fuel composition comprising:

(a) a major amount of fuel containing less than about 0.2 weight percent sulfur; and, (b) a minor amount of a fuel additive composition comprising the reaction product of:

(1) a first glyceride possessing an unsaturated fatty acid content of at least about 40 mole %, based on the total weight of the fatty acids present in the first glyceride, and an iodine number of greater than 35;

(2) a second glyceride possessing an unsaturated fatty acid content of less than about 20 mole %, based on the total weight of the fatty acids present in the second glyceride, and an iodine number of less than 35; and, (3) at least one alkanolamine.

Also provided is a method of operating an internal combustion engine comprising operating the engine with a fuel composition comprising:

(a) a major amount of a fuel containing less than about 0.2 weight percent sulfur; and, (b) a minor amount of a fuel additive composition comprising the reaction product of:

(1) a first glyceride possessing an unsaturated fatty acid content of at least about 40 mole %, based on the total weight of the fatty acids present in the first glyceride, and an iodine number of greater than 35;

(2) a second glyceride possessing an unsaturated fatty acid content of less than about 20 mole %, based on the total weight of the fatty acids present in the second synthetic oil, and an iodine number of less than 35; and, (3) at least one alkanolamine, It has been unexpectedly observed that the fuel additive of this invention produced from first and second glycerides and alkanolamine exhibits improved low temperature dissolution properties compared to a fuel additive produced from the second glyceride alone and alkanolamine. The unique mixed-glyceride fuel additive composition of this invention achieves this optimization of low temperature dissolution properties while simultaneously enhancing vehicle fuel economy and reducing vehicle engine deposits. While not wishing to be bound by theory, it is believed by the inventors that this unanticipated improvement is the result of the higher unsaturation content present in the fuel additive concentrate of this invention relative to fuel additives produced from the second glyceride alone and alkanolamine.

The term "fuel" as utilized herein shall be understood as referring to hydrocarbon fuel such as gasoline, fuel oils such as diesel fuel, alcoholic fuels such as methanol or ethanol, and mixtures of any of the foregoing.

The term "low sulfur" as applied to the fuel herein shall be understood as referring to the presence of less than about 0.2 wt. % elemental sulfur in the fuel.

The term "diesel" as utilized herein shall be understood as referring to that fraction of crude oil that distills after kerosene and is useful for internal combustion in compression-ignition engines.

The term "gasoline" as utilized herein shall be understood as referring to a fuel for spark-ignition internal combustion engines containing volatile flammable liquid hydrocarbons derived from crude petroleum by processes such as distillation reforming, polymerization, catalytic cracking and alkylation.

The term "glyceride" utilized herein refers to glycerides that are derived from natural, i.e., animal or plant, sources, and to glycerides that are synthetically produced. Glycerides are esters of glycerol (a trihydric alcohol) and fatty acids in which one or more of the hydroxyl groups of glycerol are esterified with the carboxyl groups of fatty acids containing from about 6 to about 23 carbon atoms. The fatty acids can be saturated or unsaturated, linear, branched or cyclic monocarboxylic acids. Where three hydroxyl groups are esterified, the resulting glyceride is denoted a "triglyceride". When only one or two of the hydroxyl groups are esterified, the resulting products are denoted "monoglycerides" and "diglycerides", respectively. Natural glycerides are mixed glycerides comprising triglycerides and minor amounts, e.g., from about 0.1 to about 40 mole percent, of mono- and diglycerides. Natural glycerides include, e.g., coconut and soybean oils. Synthetically produced glycerides are synthesized by the condensation reaction between glycerol and a fatty acid or mixture of fatty acids containing from about 6 to about 23 carbon atoms. The fatty acid can be a saturated or unsaturated, linear, branched or cyclic monocarboxylic acid or mixture thereof. The fatty acid itself can be derived from natural, i.e., plant or animal, sources. Examples include caproic, caprylic, capric, lauric, myristic, palmitic, stearic, arachidic, oleic, linoleic and linolenic acids, and mixtures of any of the foregoing. The synthetically produced glycerides will contain from about 80 to about 100 mole percent triglycerides with the balance, if any, representing from about 0 to about 20 mole percent mono and di-glycerides, present in admixture with triglycerides.

The term "iodine value" as utilized herein is a well known measure of unsaturation and is the percentage of iodine that will be absorbed by a chemically unsaturated substance in a given time under arbitrary conditions. Iodine values can be calculated under ASTM D5554-95.

DETAILED DESCRIPTION OF THE PREFERRED EMBODIMENTS

Glycerides utilized in accordance with the practice of this invention can be divided into two categories: (1) first glycerides possessing an unsaturated fatty acid content of at least about 40 wt. %, based on the total weight of the fatty acids present in the first glyceride, and an iodine number of greater than 35, preferably greater than 80; and, (2) second glycerides possessing an unsaturated fatty acid content of less than about 20 wt. %, based on the total weight of the fatty acids present in the second glyceride, and an iodine number of less than 35, preferably less than 25. It is preferred to utilize glycerides which are derived from natural sources mainly due to their ready availability and low cost.

First glycerides include, but are not limited to, tallow, lard, palm, castor, cottonseed, corn, peanut, soybean, sunflower, olive, whale, menhaden, sardine oils, etc., and combinations thereof. Soybean oil is the preferred first glyceride. Soybean oil generally possesses a total unsaturated fatty acid content of approximately 84.7 mole percent, with approximately 23.4 mole percent representing monounsaturated fatty acids and approximately 61.3 mole percent representing polyunsaturated fatty acids. The balance of soybean oil is comprised of approximately 15.4 mole percent saturated fatty acids. The monounsaturated fatty acids present in soybean oil include palmitic acid (cis-9-hexadecenoic acid) and oleic acid (cis-9-octadecenoic acid). The polyunsaturated fatty acids present in soybean oil include linoleic acid and linolenic acid.

Second glycerides include, but are not limited to, coconut, palm kernel oils and combinations thereof. Coconut oil is the preferred second glyceride. Coconut oil possesses a total unsaturated fatty acid content of approximately 8.8 mole percent, with approximately 6.8 mole percent representing monounsaturated fatty acids and approximately 2.0 mole percent representing polyunsaturated fatty acids. The balance of coconut oil is comprised of approximately 91.2 mole percent saturated fatty acids. The saturated fatty acids present in coconut oil include caproic acid (hexanoic acid), caprylic acid (octanoic acid), capric acid (decanoic acid), lauric acid (dodecanoic acid), myristic acid (tetradecanoic acid), palmitic acid (hexadecanoic acid), stearic acid (octadecanoic acid) and arachidic acid (eicosenic acid). The monounsaturated fatty acid present in coconut oil include oleic acid (cis-9-octadecenoic acid). The polyunsaturated fatty acids include linoleic acid and linolenic acid.

Where the first and/or second glycerides are synthetically produced, glycerol is esterified in a condensation reaction with at least one fatty acid. Fatty acids are a class of compounds containing long hydrocarbon chains and a terminal carboxylate (—COOH) group and are characterized as unsaturated, polyunsaturated, or saturated depending upon whether a double bond or bonds is present in the hydrocarbon chain. Examples of unsaturated and polyunsaturated fatty acids include oleic acid, linoleic acid, linolenic acid, and the like. Examples of saturated fatty acids include, e.g., caproic acid, caprylic acid, capric acid, lauric acid, myristic acid, palmitic acid, stearic acid, arachidic acid, behenic acid, lignoceric acid, and the like. The fatty acids which are esterified with glycerol to synthetically produce glycerides include saturated linear fatty acids having about 6 to about 23 carbon atoms, saturated branched fatty acids having about 6 to about 23 carbon atoms, saturated fatty acids having a cycloalkyl moiety and having about 6 to about 23 carbon atoms in total, unsaturated linear fatty acids having about 6 to about 23 carbon atoms and unsaturated branched fatty acids having about 6 to about 23 carbon atoms. The fatty acids used are preferably those having 11 to 23 carbon atoms, more preferably those having 14 to 22 carbon atoms, and most preferably those having 14 to 18 carbon atoms.

The fatty acids are reacted with glycerol under condensation reaction conditions. Generally, a mixture of fatty acids is used as a fatty acid raw material. It will be understood by those skilled in the art that in order to produce the first glyceride utilized herein it will be necessary to employ a mixture of fatty acids which is high in unsaturation. The fatty acid mixture utilized to produce the first glyceride is preferably a mixture comprising, based on the total weight of the mixture, 75 to 85 mole percent of an unsaturated fatty acid having one double bond, 5 to 10 mole percent of an unsaturated fatty acid having two double bonds, and 5 to 20 mole percent of a saturated fatty acid; more preferably a mixture comprising, based on the total weight of the mixture, 75 to 85 mole percent of an unsaturated fatty acid having one double bond and having 14, 16 or 18 carbon atoms, 5 to 10 mole percent of an unsaturated fatty acid having two double bonds and having 18 carbon atoms, and 5 to 20 mole percent of a saturated fatty acid having 14, 16 or 18 carbon atoms; and most preferably a mixture comprising, based on the total weight of the mixture, 68 to 78 mole percent of oleic acid (9-octadecenoic acid). In order to produce the second glyceride utilized herein, it will be necessary to employ a mixture of fatty acids which is relatively low in unsaturation. Thus, the fatty acid mixture utilized to produce the second glyceride is preferably a mixture comprising, based on the total weight of the mixture, 5 to 20 mole percent of an unsaturated fatty acid having one double bond, 5 to 10 mole percent of an unsaturated fatty acid having two double bonds, and 75 to 85 mole percent of a saturated fatty acid; more preferably a mixture comprising, based on the total weight of the mixture, 5 to 20 mole percent of an unsaturated fatty acid having one double bond and having 14, 16 or 18 carbon atoms, 5 to 10 mole percent of an unsaturated fatty acid having two double bonds and having 18 carbon atoms, and 75 to 85 mole percent of a saturated fatty acid having 14, 16 or 18 carbon atoms; and most preferably a mixture comprising, based on the total weight of the mixture, 68 to 78 mole percent of stearic acid.

The condensation reaction between glycerol and fatty acid can be effected in the presence of a solvent. The solvent is inactive to the reaction, and examples thereof include aromatic compounds such as benzene, toluene and xylene. In some cases, water and/or solvent may be removed from the reaction mixture during or after the esterification. In such a case, the water and/or the solvent is (are) recovered by distillation. When a solid matter is present in the reaction mixture, the solid matter is removed by filtering or centrifuging the reaction mixture, if necessary.

In order to accelerate the reaction, acid catalysts such as sulfuric acid and p-toluenesulfonic acid, or metal catalysts such as tin oxide and tetraphenoxytitanium can be used as well. The catalyst is used in an amount of, e.g., 0.01 to 10% by weight, based on the weight of the fatty acid.

The reaction temperature is usually about 1000 to about 300° C., preferably about 100° to about 250° C., depending on the reaction conditions, the amount of the catalyst, and the raw materials. The reaction pressure is not specifically restricted, and it may be effected under atmospheric pressures or under reduced pressure. The reaction time, which varies depending on the raw materials employed, the amount of the catalyst and the kind of the catalyst, is usually about 1 to about 100 hours.

A method for obtaining glycerides from the reaction mixture after the completion of the condensation reaction is not specifically restricted. For example, in the case where a catalyst is used, glycerides can be obtained by filtering the reaction mixture to remove the catalyst, and optionally distilling the resulting filtrate. In the case where the filtrate is difficult to pass through the filter in filtering the reaction mixture, a filtering aid can be used.

The first and second glycerides suitable for this invention will be employed in molar ratios ranging from about 1:250 to about 250:1, preferably from about 1:100 to about 100:1, most preferably from about 1:10 to 10:1, respectively.

The alkanolamine is a primary or secondary amine which possesses at least one hydroxy group. The expression "alkanolamine" is used in its broadest sense to include compounds containing at least one primary or secondary amine and at least one hydroxy group, for example, monoalkanolamines, dialkanolamines, and so forth. It is believed that any alkanolamine can be used, although preferred alkanolamines are lower alkanolamines, generally having from about two to about six carbon atoms. The alkanolamine can possess O or N functionality in addition to one amino group (that group being a primary or secondary amino group) and at least one hydroxy group. The alkanolamine preferably possesses the general formula $HN(R'OH)_{2-a}$, $H_a$ wherein R' is a lower hydrocarbyl generally having from about two to about six carbon atoms and "a" is 0 or 1. Suitable alkanolamines include monoethanolamine, diethanolamine, propanolamine, isopropanolamine, dipropanolamine, di-isopropanolamine, butanolamine, aminoethylaminoethanol such as 2-(2-aminoethylamino) ethanol. Mixtures of two or more alkanolamines can be employed. Diethanolamine is highly preferred for use in accordance with the practice of the present invention.

The molar ratio of the combined first and second glycerides to alkanolamine can generally range from about 1:0.5 to about 1:100, preferably from about 1:1 to about 1:5, more preferably from about 1:1 to about 1:2 and most preferably from about 1:1 to about 1:1.8. In general, use of a molar excess of alkanolamine is preferred in accordance with the practice of the present invention.

The reaction can be conducted by heating a mixture of first and second glycerides and the alkanolamine in the desired ratio to produce the desired product. Alternatively, the first glyceride can be reacted with alkanolamine followed by addition of second glyceride, or vice versa. The reaction can typically be conducted by maintaining the reactants at about 100° C.–200° C., preferably about 120° C.–150° C. for 1–10 hours, preferably 2–4 hours. The reaction can be solventless or carried out in aromatic solvent, preferably one which is utilized in the final product. Useful aromatic solvents include, but are not limited to, e.g., Aromatic-100, Aromatic-150, Shellsolv AB, Avjet, toluene, xylene, and mixtures thereof.

To prepare a concentrate which is suitable for rack injection and is stable at low temperature, it may be necessary to add aromatic solvent to the reaction product. The reaction product is present in the concentrate in an amount ranging from about 0.5 to about 90 weight percent, preferably from about 5 to about 70 weight percent, most preferably from about 10 to about 40 weight percent, based on the total weight of the concentrate.

It will be readily understood and appreciated by those skilled in the art that the reaction product constitutes a complex mixture of compounds including fatty amides, fatty acid esters, fatty acid ester-amides, unreacted starting reactants, free fatty acids, glycerol, and partial fatty acid esters of glycerol (i.e., mono- and di-glycerides). Fatty amides are formed when the amine group of the alkanolamine reacts with the carboxyl group of a fatty acid. Fatty acid esters are formed when one or more hydroxyl groups of the alkanolamine react with the carboxyl group of a fatty acid. Fatty acid ester-amides are formed when both the amine and hydroxyl group of alkanolamine react with carboxyl groups of fatty acids. Typically, the reaction product will contain 5–65 mole % of fatty amide, 3–30 mole % fatty acid ester, 5–65 mole % fatty acid ester-amide, 0.1–50 mole % partial fatty acid ester, 0.1–30 mole % glycerol, 0.1–30 mole % free fatty acids, 0.1–30 mole % charge alkanolamine, 0.1–30 mole % charge glycerides, etc. It is not necessary to isolate one or more specific components of the product mixture. Indeed, the reaction product mixture is preferably employed as is in the additive composition of this invention.

The additive composition of the invention can be admixed with other additives to enhance performance. For example, the additive composition can be blended with detergents, antioxidants, corrosion inhibitors, dehazers, demulsifiers, metal deactivators, antifoaming agents, combustion improvers such as cetane improvers, co-solvents, package compatibilisers, deodorants and metallic-based additives such as metallic combustion improvers, anti-knock compounds, anti-icing additives, corrosion-inhibitors, dyes, etc.

In accordance with the practice of this invention, the additive concentrate can be added to the low sulfur fuel in a minor effective amount. The additive of the invention is particularly effective in amounts ranging from about 500 ptb to about 5000 ptb of the total fuel composition, preferably from about 500 ptb to about 2500 ptb.

The low sulfur fuel in which the additive concentrate of the invention can be used can be any hydrocarbon fuel, e.g., diesel, gasoline, kerosene, jet fuels, etc.; alcoholic fuels such as methanol or ethanol; or a mixture of any of the foregoing. When the low sulfur fuel is diesel, such fuel generally boils above about 212° F. The diesel fuel can comprise atmospheric distillate or vacuum distillate, or a blend in any proportion of straight run and thermally and/or catalytically cracked distillates. Preferred diesel fuels have a cetane number of at least 40, preferably above 45, and more preferably above 50. The diesel can have such cetane numbers prior to the addition of any cetane improver. The cetane number of the fuel can be raised by the addition of a cetane improver.

When the low sulfur fuel is gasoline, it can be derived from straight-chain naphtha, polymer gasoline, natural gasoline, catalytically cracked or thermally cracked hydrocarbons, catalytically reformed stocks, etc. It will be understood by one skilled in the art that gasoline fuels typically boil in the range of about 80°–450° F. can contain straight chain or branched chain paraffins, cycloparaffins, olefins, aromatic hydrocarbons, and any mixture of these.

Generally, the composition of the low sulfur fuel is not critical and any conventional motor fuel base can be employed in the practice of this invention.

The sulfur content of the fuel of this invention is 0.2% by weight or less, preferably 0.05% by weight or less, more preferably 0.01% by weight or less, and most preferably 0.001% by weight or less based on the weight of the fuel. The art describes methods for reducing the sulfur content of hydrocarbon based fuels. Such methods include solvent extraction, sulfuric acid treatment, and hydrodesulfurisation.

A fuel composition containing the additive concentrate of the invention is suitable for the operation of an internal combustion engine. When the base fuel is diesel, the fuel composition will be suitable for use in e.g., compression-ignition engines typically operated on such fuels. When the base fuel is gasoline, the fuel composition will be suitable for use in, e.g., spark-ignition engines typically operated on such fuels. It will be understood that fuel compositions containing the fuel composition of the invention can be used to operate a variety of engines and in any other application requiring a low sulfur fuel having improved lubricity.

The following examples illustrate the practice of the present invention.

PART I SYNTHESIS OF FRICTION MODIFIERS

COMPARATIVE EXAMPLE A

Preparation of the Condensation Reaction Product of Cochin Coconut Oil and Diethanolamine A reaction kettle containing a thermometer, condenser with a nitrogen egress tube, and a mechanical stirrer with a Teflon propeller was charged with 189 g (1.8 mole) diethanolamine (ABITEC Corporation, Columbus, Ohio) and 658 g (1.0 mole) Cochin coconut oil (ABITEC Corporation, Columbus, Ohio). The mixture was nitrogen sparged for 10 minutes, heated to 140° C. for 4 hours under nitrogen, then cooled and quantitatively isolated as a light amber liquid.

COMPARATIVE EXAMPLE B

Preparation of the Condensation Reaction Product of Soybean Oil and Diethanolamine The reaction for Comparative Example A was repeated using 892 g (1.0 mole) soybean oil (ABITEC Corporation, Columbus, Ohio) in place of coconut oil.

EXAMPLES 1–11

Preparation of Condensation Reaction Products of Cochin Coconut Oil, Soybean Oil and Diethanolamine Condensation reaction products were obtained by reacting a mixture of Cochin coconut oil and soybean oil with diethanolamine in mole ratios of 1.0 moles of the mixture of Cochin coconut oil and soybean oil to 1.81 moles diethanolamine, respectively, as described in the reaction for Comparative Example A.

Examples 1–11 and Comparative Examples A and B are summarized in Table 1 below.

TABLE 1

| Example | Coconut Oil[a] (mole %) | Soybean Oil[b] (mole %) |
|---|---|---|
| A | 100 | 0 |
| B | 0 | 100 |
| 1 | 90 | 10 |
| 2 | 80 | 20 |
| 3 | 75 | 25 |
| 4 | 70 | 30 |
| 5 | 60 | 40 |
| 6 | 50 | 50 |
| 7 | 40 | 60 |
| 8 | 30 | 70 |
| 9 | 25 | 75 |
| 10 | 20 | 80 |
| 11 | 10 | 90 |

[a]MW ~~ 654 g/mol
[b]MW ~~ 892 g/mol

PART II HONDA GENERATOR

The Honda Generator Test was developed to evaluate the effect of additives on intake valve deposits and their ability to prevent intake valves from sticking. The Honda generator employed in this test was a 4-stroke, overhead cam, 2-cylinder water-cooled engine. The Honda Generator Test was run for 80 hours at which point the cylinder head, camshaft, intake valve keepers, springs and valve guide seals were disassembled. The intake valves were disturbed as little as possible. The cylinder head with intake valves in place was placed into a freezer at approximately 2° F. for a period of between 12–24 hours. The amount of force in pounds to push open the valve was then determined and assigned a qualitative "valve stickiness" rating of excessive push, moderate push, light push, or no push. Stickiness ratings of light push or no push are passes. In addition, the intake valves were then visually rated and assigned a qualitative "cleanliness rating" on a scale ranging from 0 to 10, with a value of 10 indicating that no deposits are present in the intake system. Cleanliness ratings of 6 or above are passes, with ratings of 8 or above being particularly good. Deposit weights were calculated by weighing the intake valves before and after the experiment.

The friction modifier of Examples 1–11 and Comparative Examples A and B were added to base fuel (gasoline with an octane number of 87) additized with a commercial fuel detergent (HiTec 4995 from Ethyl Corporation, Richmond Va.). Table 2 summarizes the Honda Generator Test results.

TABLE 2

| Material | Detergent Additive (PTB) | Friction Mofidier (PTB) | Cleanliness Rating | Deposit Weight (mg) | Valve Stickiness |
|---|---|---|---|---|---|
| Comparative Example A | 100 | 52 | 9.3 | 102 | Light Push |
| Comparative Example B | 100 | 52 | 6.1 | 404 | Moderate Push |
| Example 1 | 100 | 52 | 8.5 | 177 | Light Push |
| Example 3 | 100 | 52 | 7.5 | 208 | Light Push |
| Example 6 | 100 | 52 | 6.8 | 266 | Light Push |
| Example 9 | 100 | 52 | 6.6 | 283 | Light Push |

It can readily be seen from the data in Table 2 above that Comparative Example B yielded significantly higher deposit weights compared to Comparative Example A and Examples 1, 3, 6, 9.

PART III LOW TEMPERATURE SOLUTION PROPERTIES

Concentrated solutions containing the friction modifiers (80 pounds per thousand barrels—"PTB") of Comparative Examples A and B and Examples 1, 3, 6 and 9, commercial detergent (HiTec 4995 from Ethyl Corporation, Richmond, Va.) (117 PTB), and solvent (185 PTB) were produced. Low temperature solution properties were visually observed after being stored for 10 days at −10, −15, and −20° C. The following solvents were employed:

| Solvent | Description |
|---|---|
| Xylene | Approximately 1:1:1 mixture of o-, m-, and p-dimethyl benzene |

-continued

| Solvent | Description |
|---|---|
| Avjet | A mixture of hydrocarbons obtained from the distillation of petroleum. Contains mixed isomers of linear and branched parrafins and alkylated one- and two-ring aromatics. May also contain small amounts of sulfur-based heterocyclics. |
| Shellsolv AB | Complex mixture of aromatic hydrocarbons. Produced by catalytic dehydrogenation of petroleum fraction containing mixed alkylated isomers of mono- and polyaromatics. |

The results are presented in Tables 3–5 below.

TABLE 3

Solution properties for Experimental Friction Modifiers at −10 deg C. for 10 days

| Material | Shellsolv AB and Xylene (1:1 v/v) | Xylene | Avjet | Shellsolv AB and Avjet (1:1 v/v) | Shellsolv AB |
|---|---|---|---|---|---|
| Comparative Example A (100% coconut oil-derived) | ppt | ppt | ppt | ppt | ppt |
| Comparative Example B (100% soybean oil-derived) | soln | soln | soln | soln | soln |
| Example 1 (90% coconut oil-derived) | soln | soln | soln | soln | soln |
| Example 3 (75% coconut oil-derived) | soln | soln | soln | soln | soln |
| Example 6 (50% coconut oil-derived) | soln | soln | soln | soln | soln |
| Example 9 (25% coconut oil-derived) | soln | soln | soln | soln | soln |

ppt = friction modifier precipitated from solvent hz = solution appeared hazy soln = friction modifier remained dissolved in solvent

TABLE 4

Solution properties for Experimental Friction Modifiers at −15 deg C. for 10 days

| Material | Shellsolv AB and Xylene (1:1 v/v) | Xylene | Avjet | Shellsolv AB and Avjet (1:1 v/v) | Shellsolv AB |
|---|---|---|---|---|---|
| Comparative Example A (100% coconut oil-derived) | ppt | ppt | ppt | ppt | ppt |
| Comparative Example B (100% soybean oil-derived) | soln | soln | soln | soln | soln |
| Example 1 (90% coconut oil-derived) | soln | hz | hz | soln | soln |
| Example 3 (75% coconut oil-derived) | soln | soln | soln | soln | soln |
| Example 6 (50% coconut oil-derived) | soln | soln | soln | soln | soln |
| Example 9 (25% coconut oil-derived) | soln | soln | soln | soln | soln |

ppt = friction modifier precipitated from solvent
hz = solution appeared hazy
soln = friction modifier remained dissolved in solvent

TABLE 5

Solution properties for Experimental Friction Modifiers at −20 deg C. for 10 days

| Material | Shellsolv AB and Xylene (1:1 v/v) | Xylene | Avjet | Shellsolv AB and Avjet (1:1 v/v) | Shellsolv AB |
|---|---|---|---|---|---|
| Comparative Example A (100% coconut oil-derived) | ppt | ppt | ppt | ppt | ppt |
| Comparative Example B (100% soybean oil-derived) | soln | soln | soln | soln | soln |
| Example 1 (90% coconut oil-derived) | soln | hz | hz | soln | soln |
| Example 3 (75% coconut oil-derived) | soln | hz | hz | hz | soln |
| Example 6 (50% coconut oil-derived) | soln | hz | hz | soln | hz |
| Example 9 (25% coconut oil-derived) | soln | soln | soln | soln | soln |

ppt = friction modifier precipitated from solvent
hz = solution appeared hazy
soln = friction modifier remained dissolved in solvent It can readily be seen from the data presented in Tables 3–5 above that Comparative Example A exhibited very poor solubility at low temperatures, whereas Comparative Example B and Examples 1, 3, 6, and 9 demonstrated significantly enhanced low temperature solubility for a variety of aromatic solvents.

PART IV LUBRICITY TESTING OF FRICTION MODIFIERS

Lubricity testing of the friction modifiers of Examples 1–11 and Comparative Examples A and B was performed at 25° C. using the High Frequency Reciprocating Rig (HFRR) method described in ASTM method D 6079–97. Wear Scar Diameter (WSD) of Friction Modifiers is calculated using Equation (1):

$$WSD=(M+N)/2 \quad \text{Eq. (1)}$$

WSD=wear scar diamater, mm

M=Major Axis, mm

N=Minor Axis, mm

The HFRR test results are summarized in Table 6. WSD values of below 0.400 are passes.

TABLE 6

| Example | Dosage (ppm) | HFRR Wear Scar Diameter (mm) |
|---|---|---|
| Comparative Example A | 100 | 0.326 |
| Comparative Example B | 100 | 0.405 |
| Example 1 | 100 | 0.344 |
| Example 3 | 100 | 0.356 |
| Example 6 | 100 | 0.378 |
| Example 9 | 100 | 0.385 |

The data in Table 6 show that Examples 1, 3, 6 and 9 are effective as friction modifiers. It is both unexpected but readily apparent that incorporating soybean oil into the reaction product mixture of coconut oil and diethanolamine significantly improves low temperature solution properties as compared to the use of coconut oil alone reacted with diethanolamine while minimizing IVD buildup (Table 2) and improving lubricity (Table 6).

What is claimed is:

1. A fuel additive concentrate for improving the lubricity of fuels containing less than about 0.2 weight percent sulfur, the concentrate comprising a fuel additive composition diluted in an aromatic solvent, said additive composition comprising at least one amide compound from a reaction product of:

(1) a first glyceride possessing an unsaturated fatty acid content of at least about 40 mole %, based on the total weight of fatty acid present in the first glyceride, and an iodine number of greater than 35;

(2) a second glyceride possessing an unsaturated fatty acid content of less than about 20 mole %, based on the total weight of the fatty acids present in the second glyceride, and an iodine number of less than 35; and, (3) at least one alkanolamine having at least two reaction sites, the reaction sites being at least an amine group and a hydroxyl group of the alkanolamine.

2. The additive composition of claim 1 wherein the first glyceride is selected from the group consisting of palm, olive, cotton seed, castor, peanut, tallow, lard, whale, sunflower, soybean oils and combinations thereof.

3. The additive composition of claim 1 wherein the second glyceride is selected from the group consisting of coconut, palm kernel oils and combinations thereof.

4. The additive composition of claim 1 wherein the first glyceride is soybean oil and the second glyceride is coconut oil.

5. The additive composition of claim 1 wherein the alkanolamine is selected from the group consisting of monoethanolamine, diethanolamine, propanolamine, isopropanolamine, dipropanolamine, di-isopropanolamine, butanolamines and aminoethylaminoethanol.

6. A fuel composition comprising:

(a) a major amount of a fuel containing less than 0.2 weight percent sulfur; and, (b) a minor amount of an additive composition, the additive composition comprising at least one amide compound from a reaction product of:

(1) a first glyceride possessing an unsaturated fatty acid content of at least about 40 mole %, based on the total weight of the fatty acids present in the first glyceride, and an iodine number of greater than 35;

(2) a second glyceride possessing an unsaturated fatty acid content of less than about 20 mole %, based on the total weight of the fatty acids present in the second glyceride, and an iodine number of less than 35; and, (3) at least one alkanolamine having at least two reaction sites, the reaction sites being at least an amine group and a hydroxyl group of the alkanolamine.

7. The fuel composition of claim 6 wherein the first glyceride is selected from the group consisting of palm, olive, cotton seed, castor, peanut, tallow, lard, whale, sunflower, soybean oils and combinations thereof.

8. The fuel composition of claim 6 wherein the second glyceride is selected from the group consisting of coconut, palm kernel oils and combinations thereof.

9. The fuel composition of claim 6 wherein the first glyceride is soybean oil and the second glyceride is coconut oil.

10. The fuel composition of claim 6 wherein the alkanolamine is selected from the group consisting of monoethanolamine, diethanolamine, propanolamine, isopropanolamine, dipropanolamine, di-isopropanolamine, butanolamines and aminoethylaminoethanol.

11. The fuel composition of claim 6 wherein the fuel is selected from the group consisting of hydrocarbon fuel, alcoholic fuel and mixtures.

12. The fuel composition of claim 6 wherein the fuel is diesel fuel.

13. A method of operating an internal combustion engine comprising providing the engine with a fuel composition comprising:

(a) a major amount of a fuel containing less than about 0.2 weight percent sulfur; and, (b) a minor amount of an additive composition, the additive composition comprising at least one amide compound from a reaction product of:

(1) a first glyceride possessing an unsaturated fatty acid content of at least 40 mole %, based on the total weight of the fatty acids present in the first glyceride, and an iodine number of greater than 35;

(2) a second glyceride possessing an unsaturated fatty acid content of less than about 20 mole %, based on the total weight of the fatty acids present in the second glyceride, and in iodine number of less than 35; and (3) at least one alkanolamine having at least two reaction sites, the reaction sites being at least an amine group and a hydroxyl group of the alkanolamine and igniting the fuel composition.

14. The method of operating an internal combustion engine of claim 13 wherein the first glyceride is selected from the group consisting of palm, olive, cotton seed, castor, peanut, tallow, lard, whale, sunflower, soybean oils and combinations thereof.

15. The method of operating an internal combustion engine of claim 13 wherein the second glyceride is selected from the group consisting of coconut, palm kernel oils and combinations thereof.

16. The method of operating an internal combustion engine of claim 13 wherein the first glyceride is soybean oil and the second glyceride is coconut oil.

17. The method of operating an internal combustion engine of claim 13 wherein the alkanolamine is selected from the group consisting of monoethanolamine, diethanolamine, propanolamine, isopropanolamine, dipropanolamine, di-isopropanolamine, butanolamines and aminoethylaminoethanol.

18. The method of operating an internal combustion engine of claim 13 wherein the fuel is selected from the group consisting of hydrocarbon fuel, alcoholic fuel and mixtures.

19. The method of operating an internal combustion engine of claim 13 wherein the fuel is diesel fuel.

20. The method of operating an internal combustion engine of claim 13 wherein the internal combustion engine is selected from the group consisting of compression ignition and spark ignition engines.

* * * * *